United States Patent [19]

Eguchi et al.

[11] 4,446,347

[45] May 1, 1984

[54] ARC-SUPPRESSING APPARATUS FOR CIRCUIT BREAKER

[75] Inventors: Kiyoshi Eguchi; Takayoshi Ishikawa; Shigemi Tamaru; Yasushi Genba; Toshihiko Kodera, all of Hiroshima, Japan

[73] Assignee: Mitsubishi Denki Kabushiki Kaisha, Tokyo, Japan

[21] Appl. No.: 365,939

[22] Filed: Apr. 5, 1982

[30] Foreign Application Priority Data

Apr. 6, 1981 [JP] Japan ..... 56-51064[U]

[51] Int. Cl.[3] ..... H01N 33/08; H01N 9/34

[52] U.S. Cl. ..... 200/144 R; 200/147 R

[58] Field of Search ..... 200/147 R, 144 R

[56] References Cited

U.S. PATENT DOCUMENTS

| | | | |
|---|---|---|---|
| 1,932,090 | 10/1933 | Slepian | 200/144 R |
| 2,160,681 | 5/1939 | Sandin | 200/147 R |
| 3,031,552 | 4/1962 | Stewart | 200/144 R |
| 3,374,332 | 3/1968 | Bould | 200/144 R |
| 3,441,699 | 4/1969 | Erickson | 200/144 R |

*Primary Examiner*—Robert S. Macon

*Attorney, Agent, or Firm*—Sughrue, Mion, Zinn, Macpeak & Seas

[57] ABSTRACT

An arc-suppressing apparatus for a circuit breaker has a pair of side plates having a plurality of first and second grooves formed therein, the second grooves being shallower than the first grooves and extending linearly from the ends of the first grooves to an end of each of the side plates. The side plates are separated by a spacing strut and loosely connected by a bolt and nut so that a space exists between the plates which is large enough to allow a plurality of grids to slide along the second grooves into the first grooves. Thereafter, the nut and bolt are tightened to firmly secure the grids in the first grooves.

8 Claims, 9 Drawing Figures

ARC-SUPPRESSING APPARATUS FOR CIRCUIT BREAKER

BACKGROUND OF THE INVENTION

1. Field of the Invention

The present device relates to an arc-suppressing apparatus for a circuit breaker operating for a comparatively large current, low-voltage air circuit breaker.

2. Description of the Prior Art

A conventional type of arc-suppressing apparatus for a circuit breaker is shown in FIGS. 1 and 2. Namely, reference numerals 1A, 1B denote a pair of side plates 1A, 1B formed from an insulating material, each having a plurality of grooves 2. Grids 4 fit into and are held by the grooves 2. A through-hole 3 is formed in each of the side plates 1A, 1B, and a bolt 5 extends through the through-hole 3 for clamping the side plates together. The grids 4, called de-ionizing grids, are formed with a magnetic material. After the grids 4 are fitted into the grooves 2, the bolt 5 is inserted in the through-hole 3 to clamp the side plates 1A, 1B with the aid of a nut (not illustrated). To assemble the conventional arc-suppressing apparatus, a plurality of grids 4 are arranged at predetermined positions, and the side plates 1A, 1B are fitted thereto. However, the arrangement of the grids 4 at the predetermined positions involves a special tool and considerable trouble.

Particularly, there are many kinds of circuit breakers and arc-suppressing apparatuses which vary in shape and size. Therefore, the above assembling problem has been a serious drawback during production.

SUMMARY OF THE INVENTION

Accordingly, an object of the present invention is to provide an arc-suppressing apparatus into which grids can be incorporated without requiring the use of any special tool.

BRIEF DESCRIPTION OF THE DRAWINGS

FIG. 5(*b*) is a front view of the side plate shown in FIG. 5(*a*);

DESCRIPTION OF THE PREFERRED EMBODIMENTS

Figure 1:
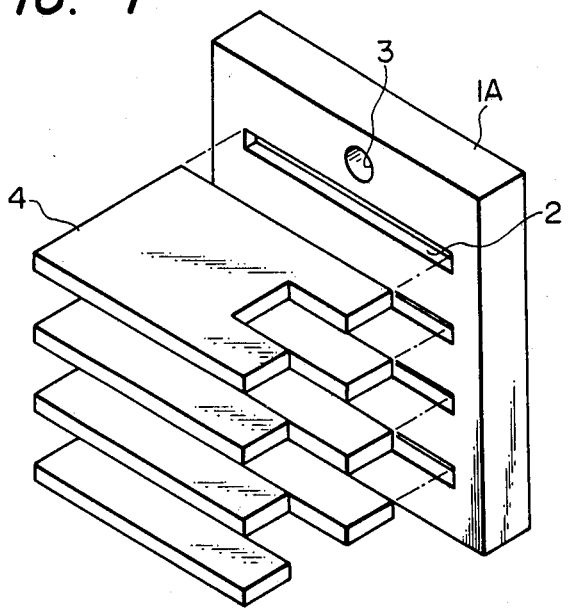
FIGS. 1 and 2 are perspective views showing a conventional arc-suppressing apparatus.
Figure 2:
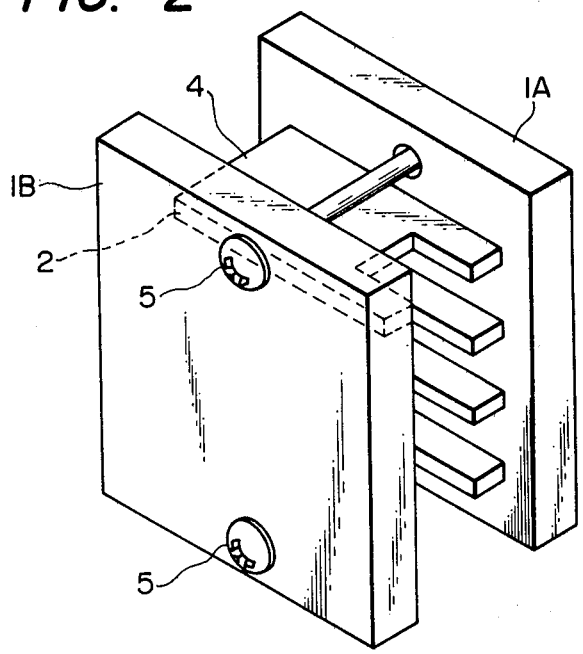
Figure 3:
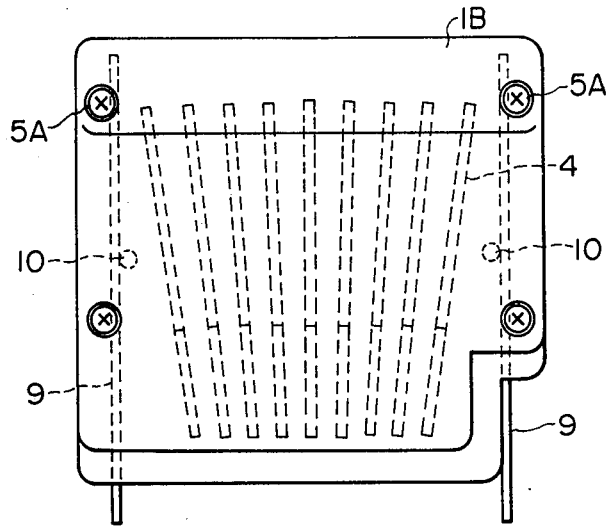
FIG. 3 is a front view of an apparatus according to the present invention.

In FIGS. 3 to 8, a pair of side plates 1A, 1B, made from a phenolic resin material, have a plurality of first grooves 2 for accommodating and supporting a plurality of de-ionizing grids 4 at predetermined positions. Additional grooves 6, 7 are formed in the side plates 1A, 1B for supporting an insulating barrier 9. Each of the side plates 1A, 1B have a through-hole 3 therein for accommodating a bolt 5A and a nut 5B, which secure the side plates together. Each of the first grooves 2 has a second groove 22 at an end thereof which is shallower than the first groove. Each of the second grooves 22 extends linearly from each of the first grooves 2 to an edge of the side plate 1A or 1B. A spacing strut 10 extends between the side plates 1A, 1B and fits into holes 8 in the side plates 1A, 1B.

Figure 4:
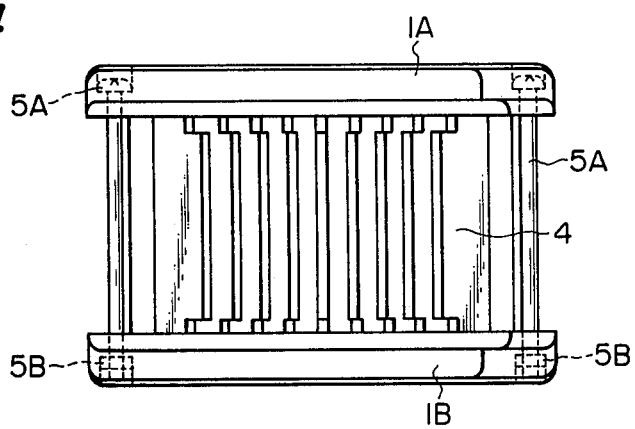
FIG. 4 is a bottom view of the apparatus of FIG. 3.
Figure 5A:
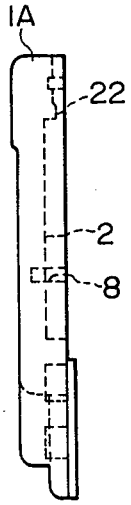
FIG. 5(*a*) is a side view of a side plate shown in FIGS. 3 and 4.
Figure 5B:
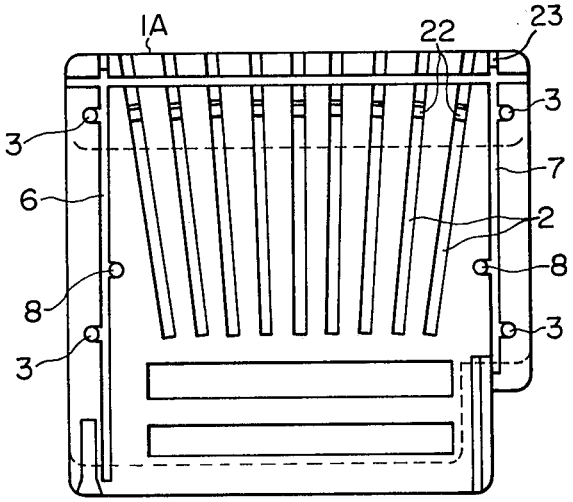
Figure 6:
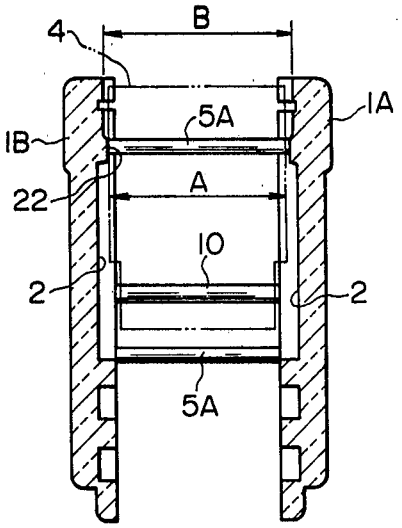
FIGS. 6, 7 and 8 are further side views of the apparatus of the present invention.
Figure 7:
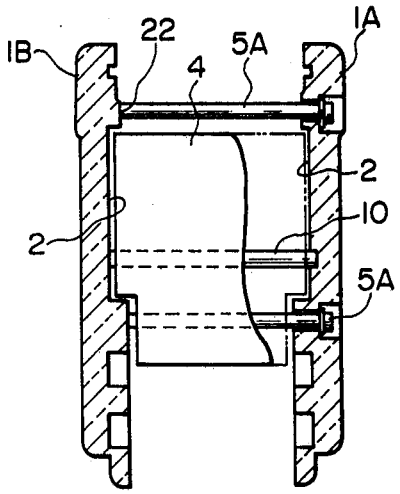

To assemble the above-described arc-suppressing apparatus, the spacing strut 10 and the insulating barrier 9 are first fitted into the side plates 1A, 1B. In this state, the spacing strut 10 and the insulating barrier 9 are fitted into an intermediate depth of the holes 8 and the grooves 6, 7, respectively, so that a space B exists between the side plates 1A, 1B, as shown in FIG. 6. The space B is slightly larger than a width A of the grids. At this time, the bolt 5A and the nut 5B can be inserted temporarily. By leaving a space B between the side plates 1A, 1B, the grids 4 can be fitted in the first grooves 2 by sliding the grids through the second groove 22, as shown in FIG. 7. Upon fitting all the grids 4 in the first grooves 2, the bolt 5A and the nut 5B can be tightened, as illustrated in FIG. 4 and FIG. 7, thereby firmly fitting the grids 4 correctly in the first grooves 2. In this state, the strut 10 and the insulating barrier 9 are fitted into the maximum depth of the holes 8 and the grooves 6, 7, respectively.

Figure 8:
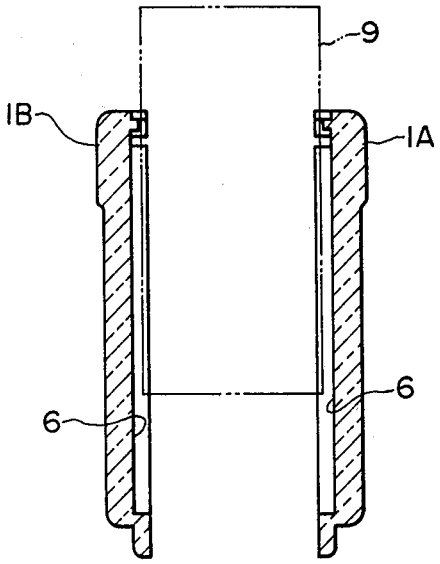

The above description refers to the case where the insulating barrier 9 is first fitted together with the spacing strut 10. However, the insulating barrier can be fitted in a manner similar to that used in fitting the grids 4 by providing a shallow fourth groove like the second groove 22 on one end of the third grooves 6, 7, as illustrated in FIG. 8.

Since the grids 4 can be fitted one-by-one during production, as described, the arc-suppressing apparatus according to the present invention is ready for easy assembling without using a special tool therefor. The apparatus is, therefore, suitable for production, and the grid can be inserted or removed easily after delivery to customers.

We claim:

1. An arc-suppressing apparatus for a circuit breaker, comprising:

at least one grid;

a pair of plates, each having at least one first groove located at a predetermined position and at least one second groove extending linearly from one end of said at least one first groove to an edge of each of said side plates, said second groove being shallower than said first groove;

said at least one grid having opposite side edges insertable into said at least one first groove by sliding said opposite side edges along said second groove on said pair of plates, said at least one grid being held by said pair of plates.

2. The arc-suppressing apparatus claimed in claim 1 further comprising a plurality of grids and a plurality of first and second grooves equal in number to the number of said plurality of grids.

3. The arc-suppressing apparatus claimed in claim 1 wherein said side plates are made from a phenolic resin material.

4. The arc-suppressing apparatus claimed in claim 1 wherein said grid is a de-ionizing grid.

5. The arc-suppressing apparatus claimed in claim 1 further comprising an insulating barrier supported by third grooves formed in each of said side plates.

6. The arc-suppressing apparatus claimed in claim 5 further comprising a bolt and a nut, said bolt passing through a hole in each of said side plates and being tightened by said nut to firmly secure said side plates together after said opposite side edges of said grid have been inserted into said first groove by sliding said opposite side edges along said second groove.

7. The arc-suppressing apparatus claimed in claim 1 further comprising a spacing strut for separating said side plates by a distance which is long enough to allow said opposite side edges of said grid to slide along said second groove into said first groove, said strut sitting in holes in said side plates.

8. The arc-suppressing apparatus claimed in claim 5 or 6 wherein a fourth groove is formed in each of said side plates, said fourth groove extending from an end of said third groove to said end of each of said side plates and being shallower than said third groove, said insulating barrier being insertable into said third grooves by sliding along and past said fourth groove.

* * * * *